US006626078B2

(12) United States Patent
Thornton

(10) Patent No.: US 6,626,078 B2
(45) Date of Patent: Sep. 30, 2003

(54) APPARATUS FOR DETECTING, IDENTIFYING, AND VALIDATING THE EXISTENCE OF BURIED OBJECTS

(75) Inventor: Anthony L. Thornton, Palmdale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/725,770

(22) Filed: Nov. 30, 2000

(65) Prior Publication Data

US 2002/0062730 A1 May 30, 2002

(51) Int. Cl.[7] ..... F41H 11/12

(52) U.S. Cl. ..... 89/1.13; 102/402; 342/29; 342/22

(58) Field of Search ..... 86/50; 89/1.13; 102/402, 403; 244/17.23, 190; 434/32; 342/22, 29

(56) References Cited

U.S. PATENT DOCUMENTS

| | | | | |
|---|---|---|---|---|
| 4,149,688 | A | * | 4/1979 | Miller, Jr. |
| 4,799,629 | A | * | 1/1989 | Mori |
| 5,017,922 | A | * | 5/1991 | Klausing et al. |
| 5,034,751 | A | * | 7/1991 | Miller, Jr. |
| 5,082,079 | A | * | 1/1992 | Lissaman |
| 5,521,817 | A | * | 5/1996 | Burdoin et al. |
| 5,575,438 | A | * | 11/1996 | McGonigle et al. |
| 5,592,170 | A | * | 1/1997 | Price et al. |
| 5,673,050 | A | * | 9/1997 | Moussally et al. |
| 5,728,965 | A | * | 3/1998 | Fesland et al. |
| 5,890,441 | A | * | 4/1999 | Swinson et al. |
| 5,936,233 | A | * | 8/1999 | Nunnally |
| 6,058,847 | A | * | 5/2000 | Adams |
| 6,142,414 | A | * | 11/2000 | Doolittle |
| 6,260,796 | B1 | * | 7/2001 | Klingensmith |
| 6,343,534 | B1 | * | 2/2002 | Khanna et al. |
| 6,450,445 | B1 | * | 9/2002 | Moller |
| 6,487,950 | B2 | * | 12/2002 | Samland |

FOREIGN PATENT DOCUMENTS

| | | | |
|---|---|---|---|
| DE | 3935012 | * | 10/1989 |
| DE | 19731724 | * | 7/1997 |
| JP | 04049803 | * | 6/1990 |
| JP | 09052600 | * | 8/1995 |
| JP | 09302628 | * | 5/1996 |
| JP | 11218399 | * | 2/1998 |
| JP | 411312015 | * | 11/1999 |

OTHER PUBLICATIONS

PCT Application WO99/05580 (cover page only), Duschek, Feb. 4, 1999.*

* cited by examiner

*Primary Examiner*—Michael J. Carone
*Assistant Examiner*—Troy Chambers

(57) ABSTRACT

A system for detecting, identifying and validating the existence of ordinance located atop or buried beneath the ground including at least one aerial platform capable of powered flight, a base station including apparatus for launching, storing, and refueling the at least one aerial platform, the base station further including apparatus for communicating with the aerial platform, and a control station remote from the base station and including apparatus for communicating with the base station such that a human operator at the control station is capable of communicating flight path instructions to the base station to be communicated to each of the aerial platforms.

8 Claims, 3 Drawing Sheets

APPARATUS FOR DETECTING, IDENTIFYING, AND VALIDATING THE EXISTENCE OF BURIED OBJECTS

BACKGROUND OF THE INVENTION

1. Field of the Invention

The present invention relates to apparatus for detecting, identifying and confirming the existence of objects buried or submerged beneath earth or water, and more particularly to a detection system comprising a plurality of autonomous flying units, a launch platform, a communications base station, and a PC-based mision planner, controller and GIS/GPS ordinance locator.

2. Description of the Related Art

Apparatus for detecting and identifying the existence of buried or submerged systems is well known in the prior art. For example, U.S. Pat. No. 4,641,566 to Pomeroy discloses a process for locating buried plastic mines or nonmetallic objects which involves spraying a suspected area with a leach of ionized metal and leaching the ionized metal into the soil to leave a metallic concentrate on an impervious object, such as a plastic mine. An array of detectors detects anomalies of concentrations of the metal, the concentrations being the result of the leach settling on or about the impervious object. U.S. Pat. No. 5,452,639 to Aulenbacher et al. discloses ground-scanning sensors mounted on a light-weight, unmanned, remote-controlled vehicle which travels over areas contaminated with buried ammunition to automatically locate and map the area without endangering the searching crew. The controlled vehicle is controlled from, and the sensor signals are evaluated in, a second vehicle which is generally disposed in the immediate vicinity of the area being examined. And U.S. Pat. No. 5,869,967 to Strauss discloses a device for the detection of objects lying in the earth which, irrespective of topography, soil structure, and state of the terrain, permits high surface yields with great precision in identifying the position of the objects to be detected without endangering the operating personnel. In particular, the device comprises at least one jib mounted on a mobile device which is swivellable about a vertical axis on whose free end are arranged adjacent to one another several measuring heads for sweeping over strip-shaped surface areas of the terrain to be investigated. With the measuring heads on the free end of the jib, at least one ground marking device is arranged for distinguishing the find site determined by the measuring heads. The ground marking device includes a paint spraying device as well as a stake marking device next to each measuring head.

Problems associated with these prior systems include their inability to "hover" at a predetermined height without being anchored or tethered. While submarines are capable of fixed depth operations, such vehicles use pumps or vertical thrusters to achieve buoyancy. Some known devices, which use gas filled flexible chambers to control buoyancy and therefore the depth of vehicle operation, are prohibitively expensive due to the supply of gas which must be carried in the vehicle for correction of depth errors over a sustained period of vehicle operation.

Against this background of known technology, the applicant has invented a novel system for detecting, identifying, and confirming the existence of buried objects, such as land mines, unexploded bombs, chemical gas canisters, etc.). More specifically, the invention comprises a colony of airborne aerial platforms launchable from a fixed or moving location, a launching device, a base station having communications equipment, a PC-based mission planner, controller and GIS/GPS ordinance locator.

OBJECTS AND SUMMARY OF THE INVENTION

It is therefore an object of the present invention to provide a novel system for detecting, identifying, and confirming the existence of buried ground ordinance, capable of overcoming many of the disadvantages and drawbacks of similar systems known in the art.

Another object of the present invention is to provide a novel system including a plurality of autonomous aerial platforms comprising a propulsion unit, a differential GPS sensor, a flight control system, a communication relay, collision avoidance sensors, and buried or submerged object detection sensors.

Still another object of the present invention is to provide an ordinance detection apparatus which includes autonomous aerial devices and a base station for coordinating activities such as launching, refueling and docking of the aerial devices, and communicating with each and all of the aerial platforms.

Still another object of the present invention is to provide a system for detecting and identifying buried or submerged ordinance including a plurality of aerial platforms bearing ordinance detection apparatus, a base station for directing operations of the aerial platform, such as launch, refueling, and docking, and a command and control center for determining the time and location parameters of the search and identification missions and for coordinating communications between the aerial platforms, the base station and the command and control center.

Other objects, advantages and features of the invention will become more apparent, as will equivalent structures which are intended to be covered herein, with the teaching of the principles of the invention in connection with the disclosure of the preferred embodiments thereof in the specification, claims and drawings in which:

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a system for detecting, identifying and verifying buried or submerged ordinance that encompasses many long sought after features that make such functions easier, less expensive, and more comprehensive.

Figure 1:
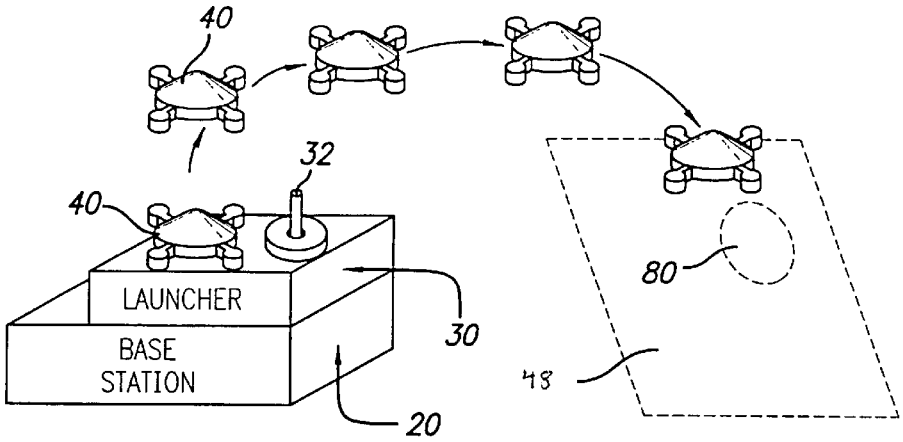
FIG. 1 is a schematic diagram depicting the components of the system of the present invention.
Figure 1:
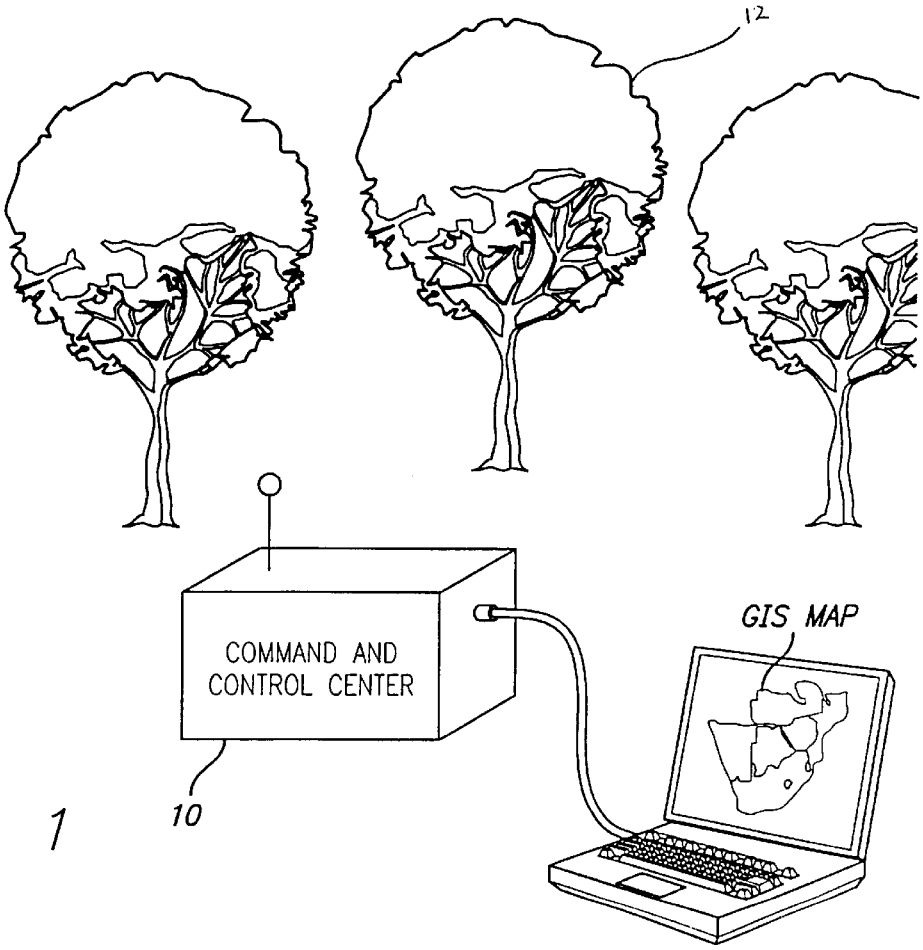

Referring first to FIG. 1 of the drawing, the system of the invention is seen to include a command and control center 10 located at a substantial distance from an area 48 that is to be searched for submerged, buried, and perhaps live, ordinance. In the depiction of FIG. 1, the command and control center is located behind a stand of trees 12, and on the other side of the trees is a base station 20 which includes a launcher apparatus 30 for launching one or more of a plurality of aerial platforms 40. The platforms 40, after launch, propel themselves to the area 60 that has been identified at the command and control center as the location that must be searched for buried ordinance, shown in dotted lines at 80.

Figure 2:
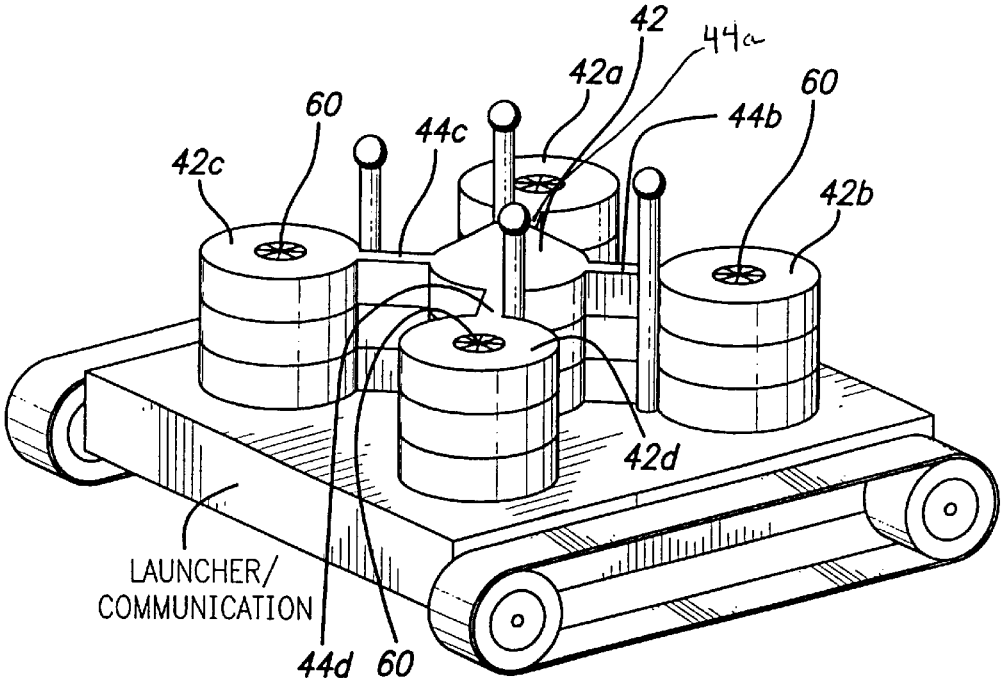
FIG. 2 depicts a first configuration of an aerial platform used with the system of the present invention.
Figure 3:
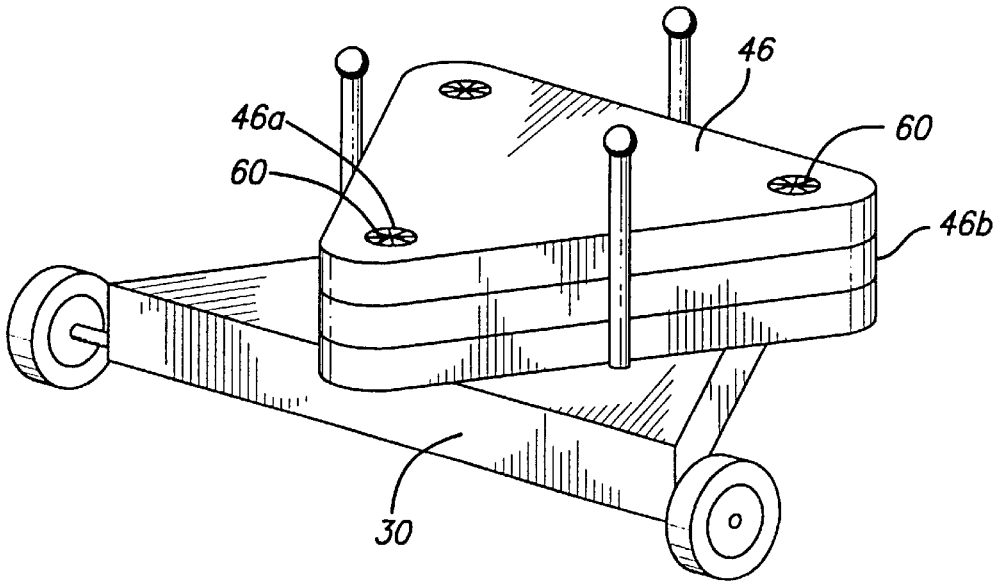
FIG. 3 depicts a second configuration of an aerial platform used with the system of the present invention.

Two configurations of the aerial platforms 40 are shown in FIGS. 2 and 3. The configuration shown in FIG. 2 is an "X-wing" sentry craft having a substantially elliptical body portion 42 about which are located four lobes 42*a*, 42*b*, 42*c*, 42*d*, preferably equally spaced about the periphery of the body portion and each of which are preferably separated from the body portion 42 by support arms 44*a*, 44*b*, 44*c*, 44*d*. The configuration shown in FIG. 3 is a "Delta-Wing" sentry craft having a substantially deltoid shaped body portion 46 bearing two lobes 46*a*, 46*b* spaced apart from one another at the ends of the base of the triangular or deltoid-shaped body portion 46.

Figure 4:
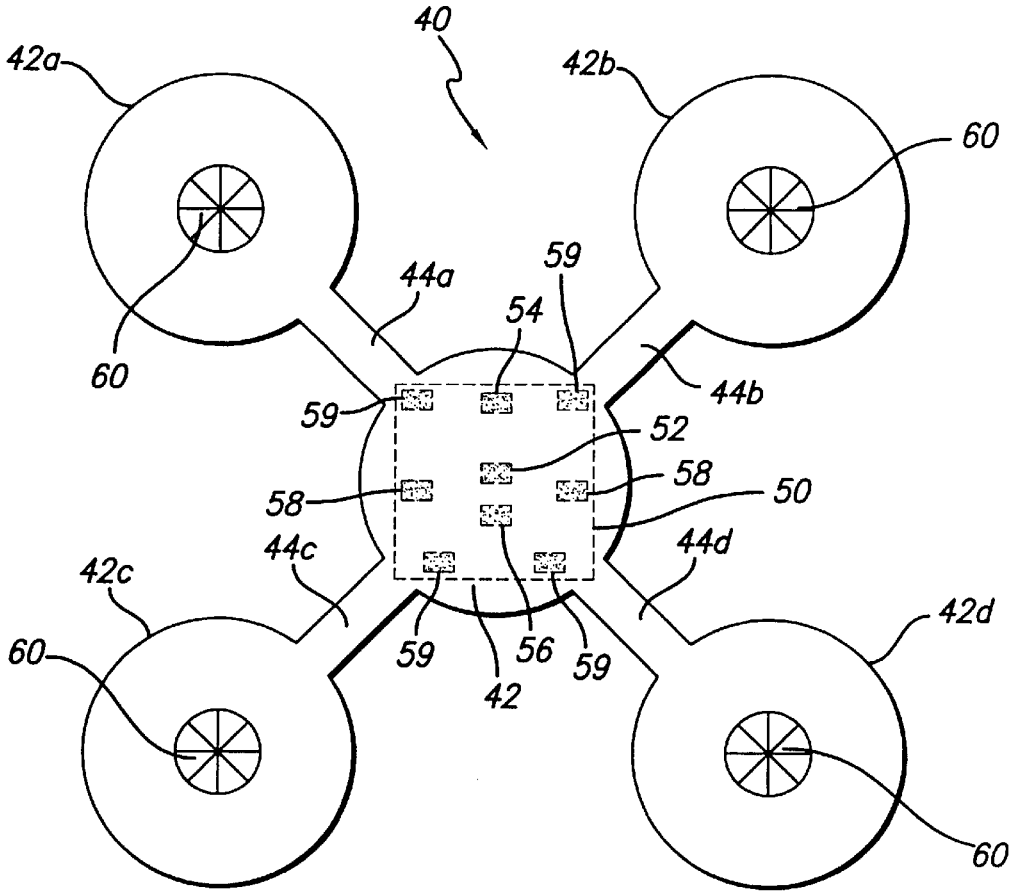
FIG. 4 depicts the electronic sensor package as deployed on an aerial platform of the present invention.

The aerial platforms 40 shown in FIGS. 1 and 4 include gimbaled lift fans 60 in each lobe. The vehicle outer skin comprises a lightweight durable plastic shell. The central interior portion of the platform contains an engine (not shown) with appropriate motor and drive shaft, and appropriate electronic apparatus 50 which is shown in FIG. 4 to include a differential GPS sensor 52, a flight control system 54, a communication relay 56, proximity and collision avoidance sensors 58, and chemical, metal, and electromagnetic detection sensors 59. Each aerial platform 40 is capable of covering a sector area equal to 1/10 square mile and then returning to the base station. Hover capability of the aerial platforms should range from 0.5 feet–10 feet above the ground level altitude and maximum speed should be in the range of from 10 mph to 20 mph.

The base station 20 (note FIG. 1 again) includes a launcher assembly 30 which serves as the storage, docking, launch, and refueling station. The base station also houses a communication link to the "colony" of aerial platforms 40. Ten aerial platforms 40 can be stored on one base station so that a single base station can cover 1 square mile. Larger area coverage is available with additional base stations. Currently, the maximum communication range is about 2 miles in radius from the base station for any one aerial platform in the "colony". Preferably, the base station will provide the following functions:

a) provide compact storage and transport of the aerial platforms in the "colony";

b) serve as a home base launch rack from which to release the "colony";

c) serve as a refueling station for returning platforms; and d) serve as a centralized, portable, communication link.

The control center 10, which is the heart of the system, permits a human operator to use Geographic Information System (GIS) information on a personal computer (PC) to map out the polygonal region to be inspected. As mentioned above, presently maximum area of which the system is capable of covering is about 1 square mile. The electronics contained in the command and control center 10 automatically decomposes or divides the region to be inspected into overlapping sub-regions, each of which is assigned to one aerial platform. Each platform 40 is then sent to the centroid of the sub-region defined by the Global Positioning System (GPS) coordinates, and upon release from the base station, flies directly to the centroid and begins an autonomous search for ordinance within the sub-region using the most efficient search pattern for the area. While in search mode, any platform 40 detecting an object that appears to be an ordinance will hover over the object and send a signal to the base station on its current GPS coordinate location that will appear on the GIS map as a colored dot. At that point, the platform 40 will hover as close as possible to the object and turn on additional sensors (electromagnetic, metal, chemical, video, etc.) to identify the type of ordinance. If verified, the colored dot will convert to a differently colored dot, or a symbol of a different configuration, which will identify the type of ordinance identified. Once identified, the search pattern will continue for that platform until it completes the assigned sub-region area. When it completes the assigned search, the aerial platform will return to the base station for refueling.

Those skilled in the art will appreciate that various adoptions and modifications of the invention as described above can be configured without departing from the scope and spirit of the invention. Therefore, it is to be understood that, within the scope of the appended claims, the invention may be practiced other than as specifically described herein.

What I claim is:

1. A system for detecting the existence of buried objects, said system comprising:

at least one aerial platform capable of powered flight, a plurality of object detection sensors on said at least one aerial platform, a base station, a communication link between said base station and said at least one aerial platform, a plurality of additional aerial platforms, and a control station remote from said base station and including means for communicating with said base station, means for defining a region to be inspected by said at least one aerial platform, wherein the means for defining a region to be inspected by said at least one aerial platform further defines a plurality of overlapping sub-regions to be inspected by the plurality of additional aerial platforms, and each of said at least one aerial platform and the plurality of additional aerial platforms includes a collision avoidance sensor; and means for displaying locations of objects detected by said at least one aerial platform.

2. The system of claim 1, wherein said at least one aerial platform is unmanned, and comprises a body portion housing engine means, flight control apparatus, and a communication relay for communicating with said base station.

3. The system of claim 2 wherein the body portion of each said aerial platform includes nodal portions arranged about the periphery of said body portion, said nodal portions housing said engine means.

4. The system of claim 3, wherein said nodal portions comprise two in number.

5. The system of claim 4, wherein said body portion comprises a deltoid configuration, and said nodal portions are disposed at end regions of the larger side of said body portion.

6. The system of claim 3, wherein said nodal portions comprise four in number.

7. The system of claim 6, wherein said body portion is disposed centrally of said nodal portions to form, with said nodal portions, an "X-shaped" configuration.

8. The system of claim 1, wherein each of said object detection sensors includes one of:

an electromagnetic sensor, a metal sensor, a chemical sensor, and a video sensor.

* * * * *